US007721658B2

(12) United States Patent
Seeley et al.

(10) Patent No.: US 7,721,658 B2
(45) Date of Patent: May 25, 2010

(54) COMPUTER WORKSTATION WITH MOVABLE MONITOR SUPPORT

(75) Inventors: Robert Seeley, Zeeland, MI (US); Joel R. Dral, Zeeland, MI (US); Jeffrey A. Weber, Golden Valley, MN (US); John F. Aldrich, Grandville, MI (US); Douglas M. VanDeRiet, Holland, MI (US)

(73) Assignee: Herman Miller, Inc., Zeeland, MI (US)

( * ) Notice: Subject to any disclaimer, the term of this patent is extended or adjusted under 35 U.S.C. 154(b) by 1091 days.

(21) Appl. No.: 11/339,988

(22) Filed: Jan. 25, 2006

(65) Prior Publication Data

US 2006/0174807 A1 Aug. 10, 2006

Related U.S. Application Data

(60) Provisional application No. 60/647,281, filed on Jan. 26, 2005.

(51) Int. Cl.
*A47B 37/00* (2006.01)

(52) U.S. Cl. ..... 108/50.01; 108/5; 108/7

(58) Field of Classification Search ..... 108/50.01, 108/50.02, 5–7, 9–10; 312/223.3; 248/292.14, 248/297.11, 297.21, 920, 923
See application file for complete search history.

(56) References Cited

U.S. PATENT DOCUMENTS

| | | | | |
|---|---|---|---|---|
| 3,840,221 | A | 10/1974 | Hogan | |
| 4,313,112 | A | 1/1982 | Foster | |
| 4,365,561 | A | 12/1982 | Tellier et al. | |
| 4,482,063 | A | 11/1984 | Berke et al. | |
| 4,493,267 | A | 1/1985 | Jedziniak | |
| 4,511,111 | A | 4/1985 | Godfrey et al. | |
| 4,515,086 | A | 5/1985 | Kwiecinski et al. | |
| 4,566,741 | A * | 1/1986 | Eriksson et al. | 312/194 |
| 4,669,789 | A | 6/1987 | Premberton | |
| 4,706,920 | A | 11/1987 | Ojima et al. | |
| 4,714,025 | A | 12/1987 | Wallin et al. | |
| 4,717,112 | A | 1/1988 | Pirkle | |

(Continued)

FOREIGN PATENT DOCUMENTS

| | | | | |
|---|---|---|---|---|
| DE | 4009536 | * | 9/1991 | 312/223.3 |

(Continued)

OTHER PUBLICATIONS

Notice of Allowance and Fees Due in U.S. Appl. No. 10/797,581, filed Mar. 10, 2004, mailed Jul. 30, 2009, 6 pages.

(Continued)

*Primary Examiner*—Hanh V Tran
(74) *Attorney, Agent, or Firm*—Brinks Hoffer Gilson & Lione

(57) ABSTRACT

A computer workstation includes a worksurface horizontally moveable from a first worksurface position to a second worksurface position. At least a portion of the worksurface rotates about a horizontal axis as the worksurface is moved from the first worksurface position to the second worksurface position. A monitor support is moveable horizontally and vertically and moveably coupled to the worksurface. The worksurface or the monitor support is moveable in response to a movement of the other of the worksurface and the monitor support.

46 Claims, 11 Drawing Sheets

U.S. PATENT DOCUMENTS 4,779,922 A 10/1988 Cooper
4,805,538 A 2/1989 Fisher et al.
4,828,342 A 5/1989 Stefan
4,880,270 A 11/1989 Cooper
4,890,561 A 1/1990 Hampshire et al.
4,915,450 A 4/1990 Cooper
4,981,085 A 1/1991 Watt
5,044,284 A 9/1991 Gross
5,056,864 A 10/1991 Cooper
5,172,641 A 12/1992 Auer
5,183,230 A 2/1993 Walker et al.
5,199,773 A 4/1993 Price, Jr. et al.
5,263,668 A 11/1993 Reiter
5,287,815 A 2/1994 Gross
5,322,026 A 6/1994 Bay
5,339,750 A 8/1994 Smies
5,398,622 A 3/1995 Lubinskas et al.
5,408,940 A 4/1995 Winchell
5,419,525 A * 5/1995 Hilton ..... 248/371
5,424,912 A 6/1995 Mikan
5,437,235 A 8/1995 Randolph
5,443,017 A 8/1995 Wacker et al.
5,450,800 A 9/1995 Leonard
5,490,466 A * 2/1996 Diffrient ..... 108/96
5,522,323 A 6/1996 Richard
5,623,881 A 4/1997 Huang
5,671,091 A * 9/1997 Monroe et al. ..... 359/635
5,680,820 A 10/1997 Randolph
5,712,761 A 1/1998 Dials et al.
5,765,910 A 6/1998 Larkin et al.
5,845,586 A 12/1998 Moore
5,857,415 A * 1/1999 Richard ..... 108/50.01
5,909,934 A 6/1999 McGraw
5,967,631 A 10/1999 Ko
5,992,810 A 11/1999 Crinion et al.
6,076,473 A 6/2000 Conte
6,092,868 A 7/2000 Wynn
6,119,605 A 9/2000 Agee
6,135,032 A 10/2000 Ko
6,269,753 B1 8/2001 Roddan
6,270,157 B1 8/2001 Kapushinski
6,296,408 B1 10/2001 Larkin et al.
6,315,358 B1 11/2001 Baru
6,374,752 B1 4/2002 Walser
6,382,745 B1 5/2002 Adkins
6,394,402 B2 * 5/2002 Coonan et al. ..... 248/123.11
6,398,326 B1 6/2002 Wang
6,439,657 B1 8/2002 Tholkes
6,446,564 B1 9/2002 Anderson
6,471,164 B2 10/2002 DiOrio
6,474,760 B2 11/2002 Rauls
6,484,648 B1 11/2002 Long
6,536,356 B2 * 3/2003 Krieger et al. ..... 108/50.01
6,568,650 B2 5/2003 Helmetsie et al.
6,615,428 B1 9/2003 Pattee
6,615,429 B2 9/2003 Weil et al.
6,691,626 B2 * 2/2004 Warner ..... 108/145
6,736,469 B2 5/2004 Long
6,745,986 B1 6/2004 Bright
6,799,816 B2 10/2004 Touzani
6,874,431 B1 4/2005 Danna
7,032,523 B2 4/2006 Forslund, III et al.
7,047,890 B2 * 5/2006 Korber et al. ..... 108/50.01
7,127,962 B2 * 10/2006 Angeles et al. ..... 74/490.05
7,322,653 B2 * 1/2008 Dragusin ..... 297/300.3
2002/0020329 A1 * 2/2002 Kowalski ..... 108/50.01
2002/0056797 A1 5/2002 Solomon et al.
2004/0256524 A1 12/2004 Beck et al.
2004/0262485 A1 12/2004 Marceau et al.
2005/0285004 A1 12/2005 Elgie et al.
2006/0174807 A1 8/2006 Dral et al.

FOREIGN PATENT DOCUMENTS

DE 42 00 965 7/1992
EP 592181 * 4/1994 ..... 312/223.3

OTHER PUBLICATIONS

Official Communication (Office Action Summary) in U.S. Appl. No. 11/339,988, filed Jan. 25, 2006, mailed May 28, 2009, 8 pages.
Office Communication (Office Action Summary) in U.S. Appl. No. 10/797,581, filed Mar. 10, 2004, mailed Jan. 13, 2009, 12 pages.
Office Communication (Office Action Summary) in U.S. Appl. No. 10/797,581, filed Mar. 10, 2004, mailed Jun. 27, 2008, 2007, 10 pages.
Office Communication (Office Action Summary) in U.S. Appl. No. 10/797,581, filed Mar. 10, 2004, mailed Nov. 28, 2007, 8 pages.
Office Communication (Office Action Summary) in U.S. Appl. No. 10/797,581, filed Mar. 10, 2004, mailed Jun. 4, 2007, 8 pages.
Office Communication (Office Action Summary) in U.S. Appl. No. 10/797,581, filed Mar. 10, 2004, mailed Aug. 24, 2006, 6 pages.
Official Communication (Office Action Summary) in U.S. Appl. No. 10/797,581, filed Mar. 10, 2004, mailed Mar. 1, 2006, 8 pages.
Office Communication (Office Action Summary and Interview Summary) in U.S. Appl. No. 10/797,581, filed Mar. 10, 2004, mailed Aug. 29, 2005, 11 pages.

* cited by examiner

COMPUTER WORKSTATION WITH MOVABLE MONITOR SUPPORT

RELATED APPLICATIONS

This application claims the benefit of U.S. Provisional Patent Application No. 60/647,281, filed Jan. 26, 2005, the entire disclosure of which is hereby incorporated herein by reference

BACKGROUND

The present invention relates generally to a computer workstation, and in particular, to a computer workstation having a movable monitor support. In many instances, a user of a computer workstation is seated at the workstation in a tiltable chair. Typically, as the user tilts rearwardly, the position of the eyes of the user travels rearwardly at a greater rate into a greater distance relative to a monitor positioned at the workstation than does the position of the hands of the user located at a keyboard positioned on the workstation. Accordingly, the user is typically required to independently readjust one or both of the worksurface, if movable, and the monitor support, if movable, when reclining to different positions to maintain an optimum position of each relative to the user, and in particular to the eyes and hands of the user.

BRIEF SUMMARY

In one aspect, one embodiment of a computer workstation includes a worksurface horizontally moveable from a first worksurface position to a second worksurface position. At least a portion of the worksurface rotates about a horizontal axis as the worksurface is moved from the first worksurface position to the second worksurface position. A monitor support is moveable horizontally and vertically and moveably coupled to the worksurface. The worksurface or the monitor support is moveable in response to a movement of the other of the worksurface and the monitor support.

In another aspect, a computer workstation includes a planetary gear assembly. The planetary gear assembly includes a sun gear, a planet gear engaging the sun gear, and a planet gear carrier rotatably attached to the planet gear. A worksurface is coupled to the planet gear carrier. A monitor support is coupled to the sun gear. At least one of the worksurface and the monitor support is moveable in response to a movement of the other of the worksurface and the monitor support.

In another aspect, a computer workstation includes a worksurface moveable a first distance from a first worksurface position to a second worksurface position. A monitor support is moveably coupled to the worksurface. A pivot mechanism couples the monitor support to a base. At least one of the worksurface and the monitor support is moveable in response to a movement of the other of the worksurface and the monitor support. The monitor support is moveable a second distance between first and second monitor positions as the worksurface is moved the first distance between the first and second worksurface positions. The second distance is greater than the first distance.

DETAILED DESCRIPTION

The contents of commonly assigned and copending U.S. application Ser. No. 10/797,581, entitled "Computer Workstation with Moveable Monitor Support," are hereby incorporated herein by reference.

Figure 1:
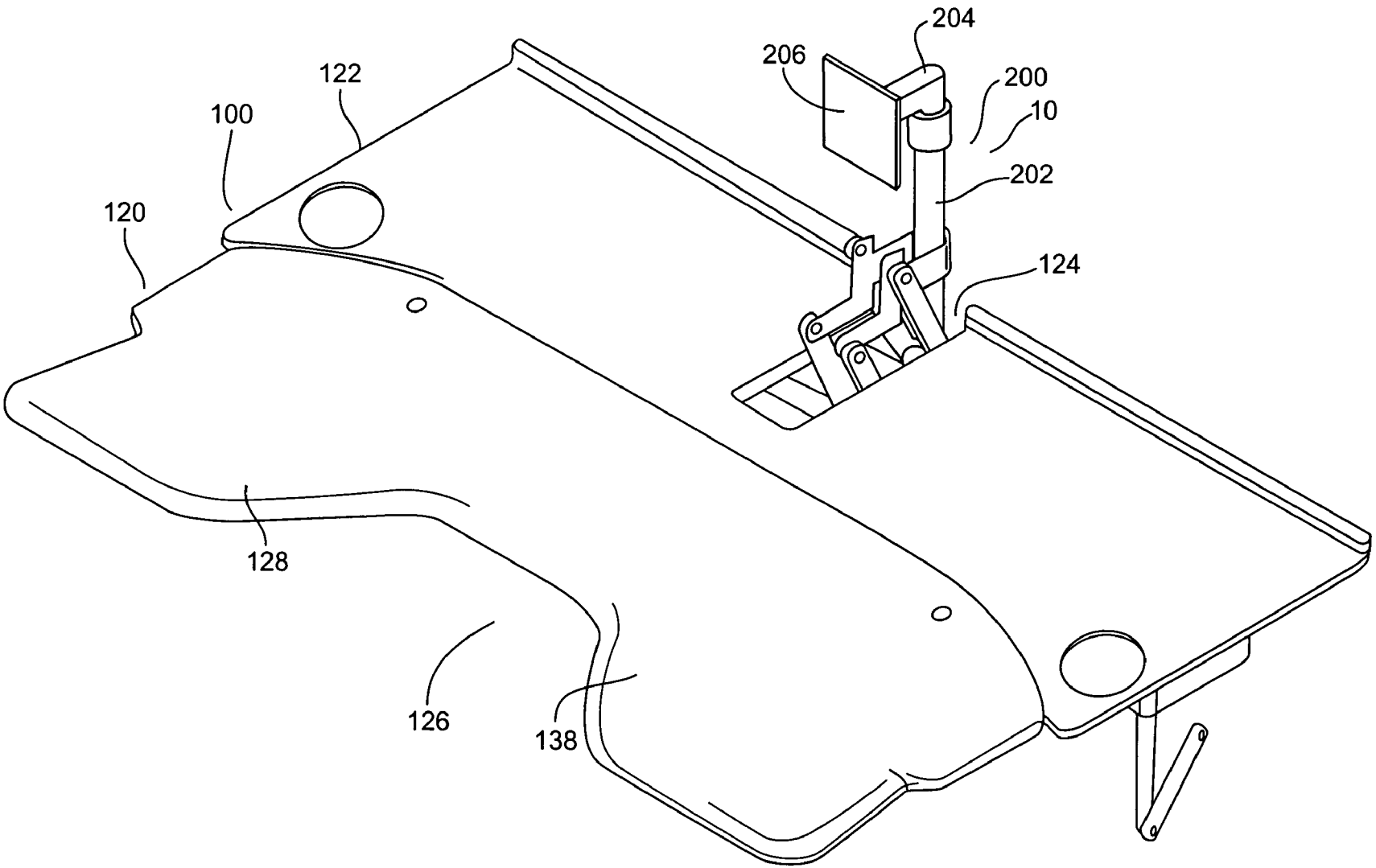
FIG. 1 is a top perspective view of a first embodiment of a computer workstation.

Referring to FIG. 1, a computer workstation 10 includes a worksurface 100 and a monitor support 200 coupled to the worksurface 100. It should be understood that the term "worksurface" as used herein, means any surface capable of supporting an object, e.g., a keyboard, a mouse, a document holder, papers, etc., and includes for example and without limitation, monitor supports, desk tops and keyboard trays. The term "coupled" generally means connected to or engaged with whether directly or indirectly, for example with an intervening member, and does not require the engagement to be fixed or permanent, although it may be fixed or permanent, and includes both mechanical and electrical connection.

Figure 2:
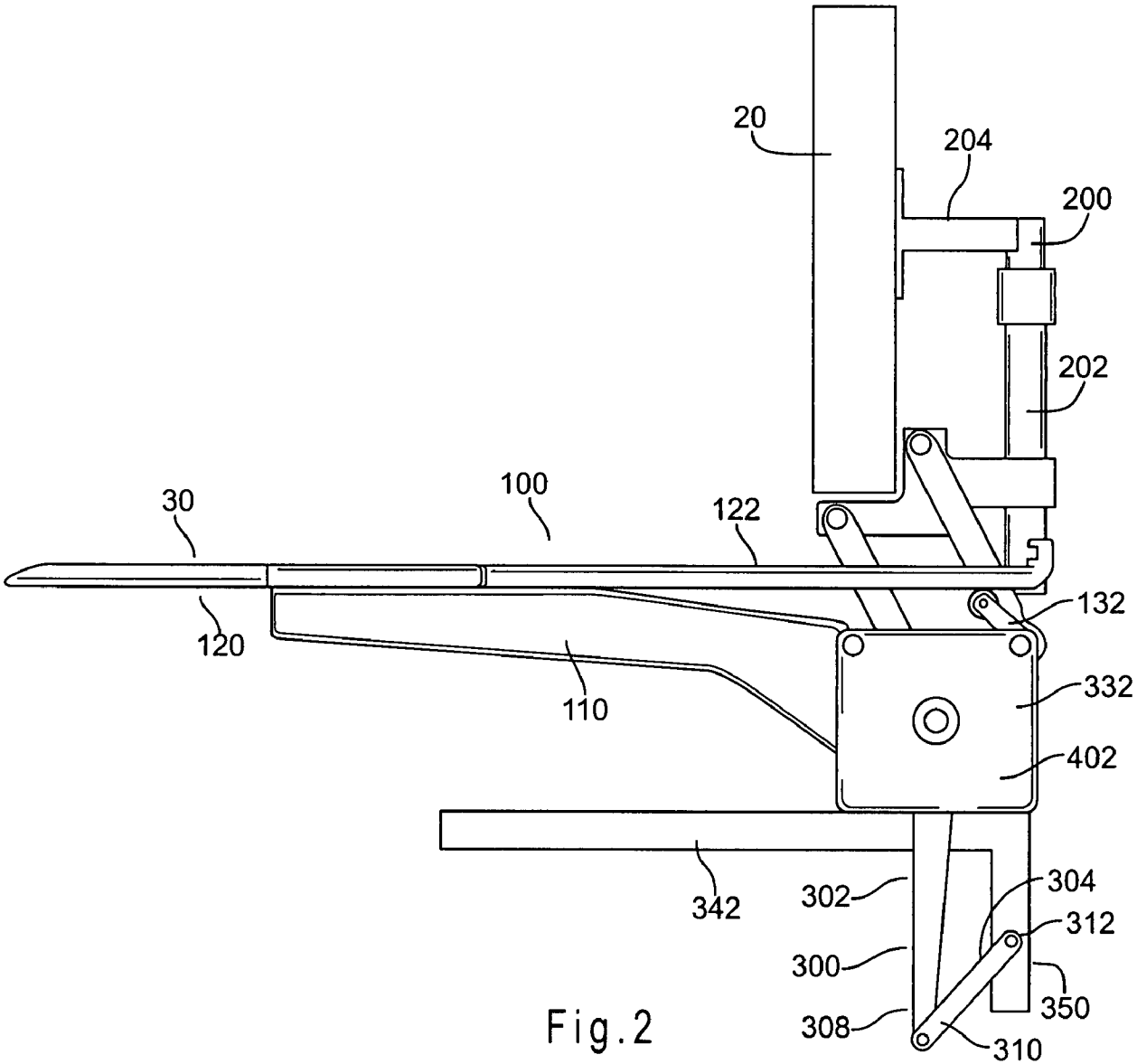
FIG. 2 is a side view of a first embodiment of a computer workstation in a first configuration.
Figure 3:
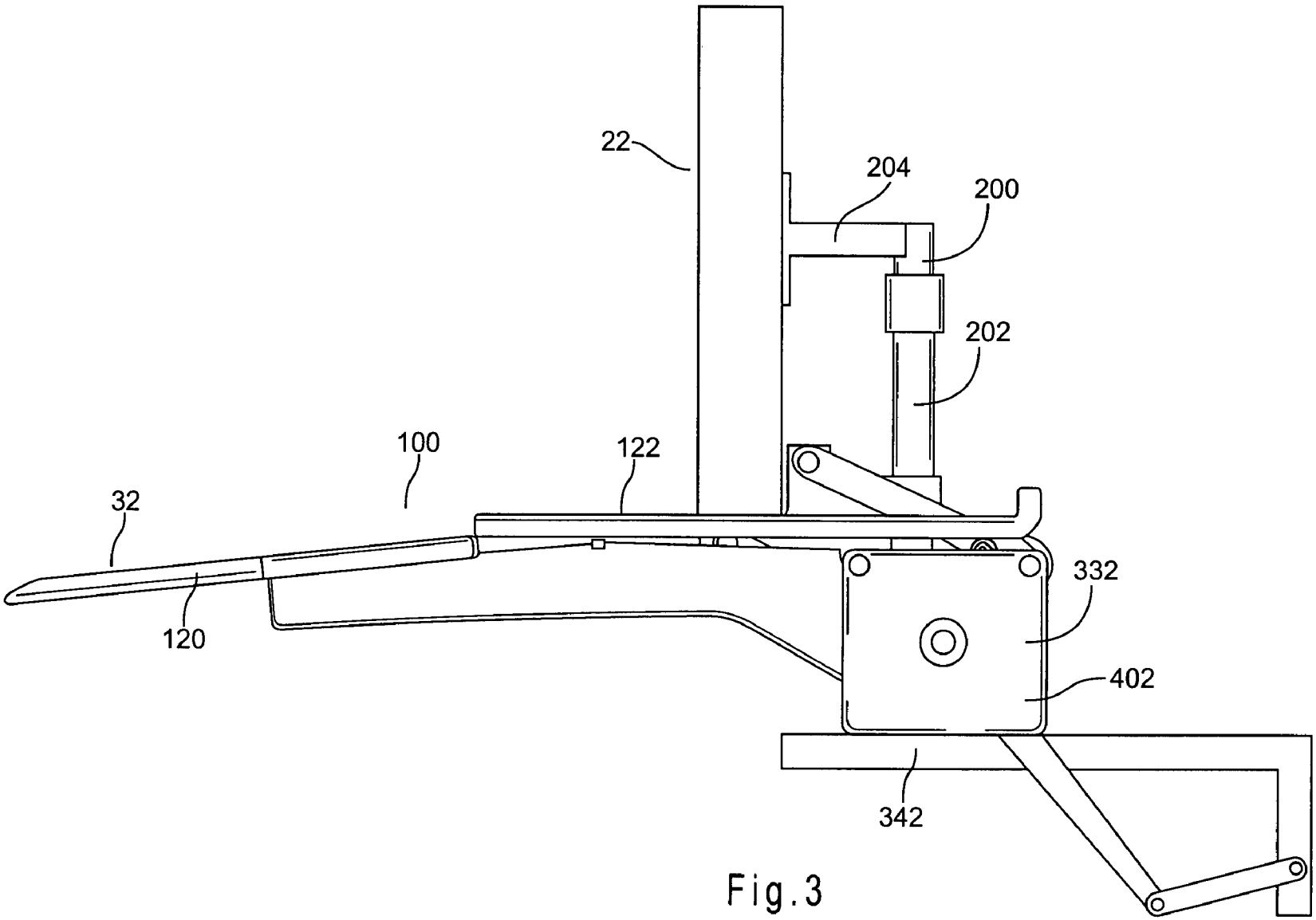
FIG. 3 is a side view of a first embodiment of a computer workstation in a second configuration.

The worksurface 100 is movable from a first worksurface position as shown in FIG. 2 to a second worksurface position as shown in FIG. 3. The worksurface 100 and the monitor support 200 are coupled, such that either of the worksurface 100 or the monitor support 200 is moveable in response to a movement of the other of the worksurface 100 and the monitor support 200. Of course, it should be understood that both the monitor support 200 and the worksurface 100 can be moved together simultaneously.

Figure 6:
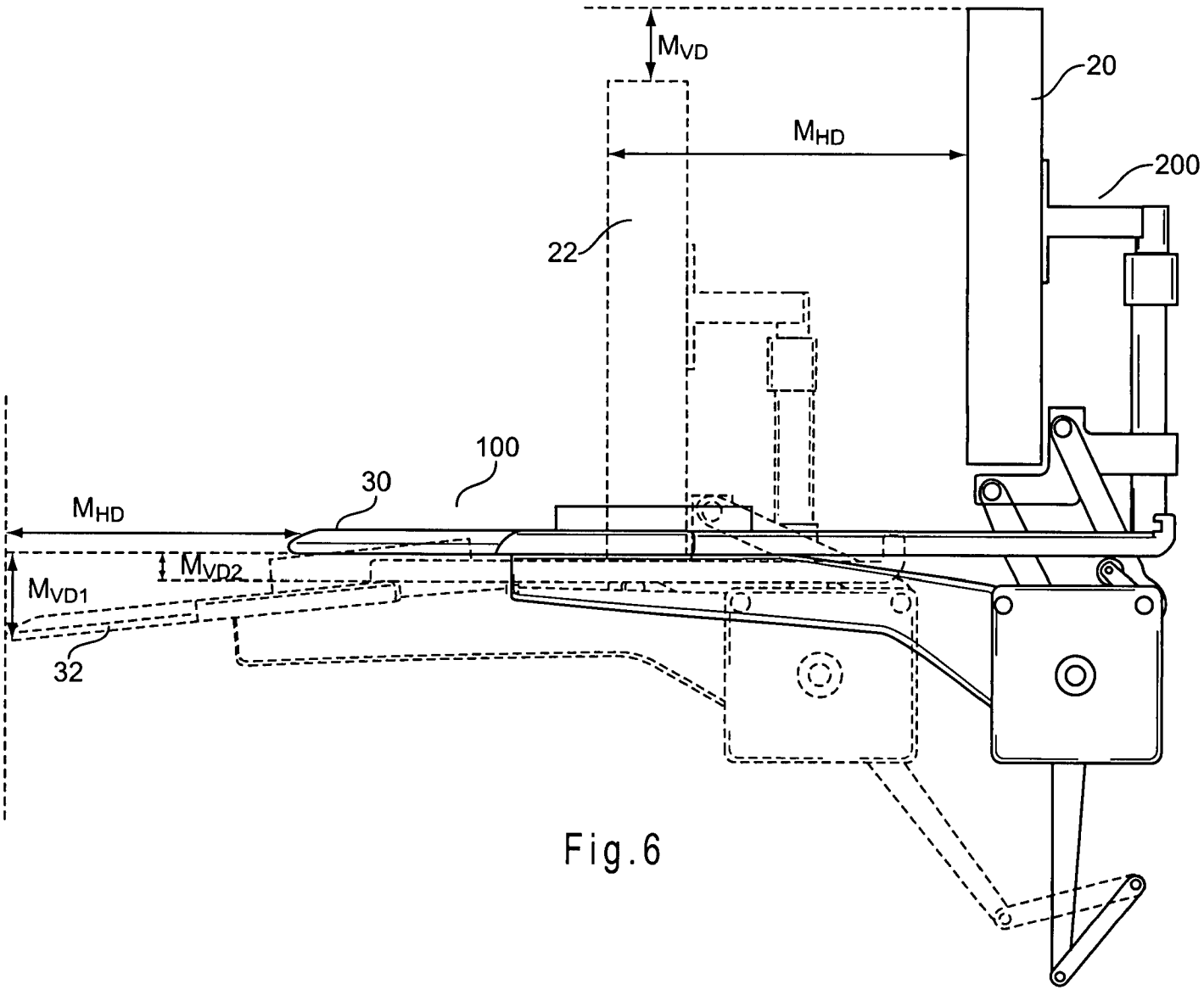
FIG. 6 is a schematic view of an embodiment a workstation being moved from a first position to a second position.

As shown in FIG. 6, as the worksurface 100 moves a horizontal distance $W_{HD}$ from a first worksurface position 30 (shown in solid lines) to a second worksurface position 32 (shown in dashed lines), the monitor support 200 also moves a horizontal distance $M_{HD}$ from a first monitor position 20 to a second monitor position 22. In one embodiment, $M_{HD}$ is greater than $W_{HD}$. In one embodiment, the monitor support 200 is moveable horizontally and vertically, and at least a portion of the worksurface 100 rotates about a horizontal axis as the worksurface 100 is moved from the first worksurface position to the second worksurface position. The monitor support 200 preferably does not rotate as it moves from a first monitor position 20 to a second monitor position 22. In one embodiment, the second position 32 of the worksurface 100 is forward and downward of the first position 30, and the second position 22 of the monitor support 200 is also forward and downward of the first position 20 of the monitor support 200. Thus, at least a portion of the worksurface 100 moves a vertical distance $W_{VD1}$. In one embodiment, a second portion of the worksurface moves a vertical distance $W_{VD2}$. As the worksurface 100 moves a vertical distance $W_{VD1}$ and/or $W_{VD2}$, the monitor support 200 also moves a vertical distance $M_{VD}$.

Figure 4:
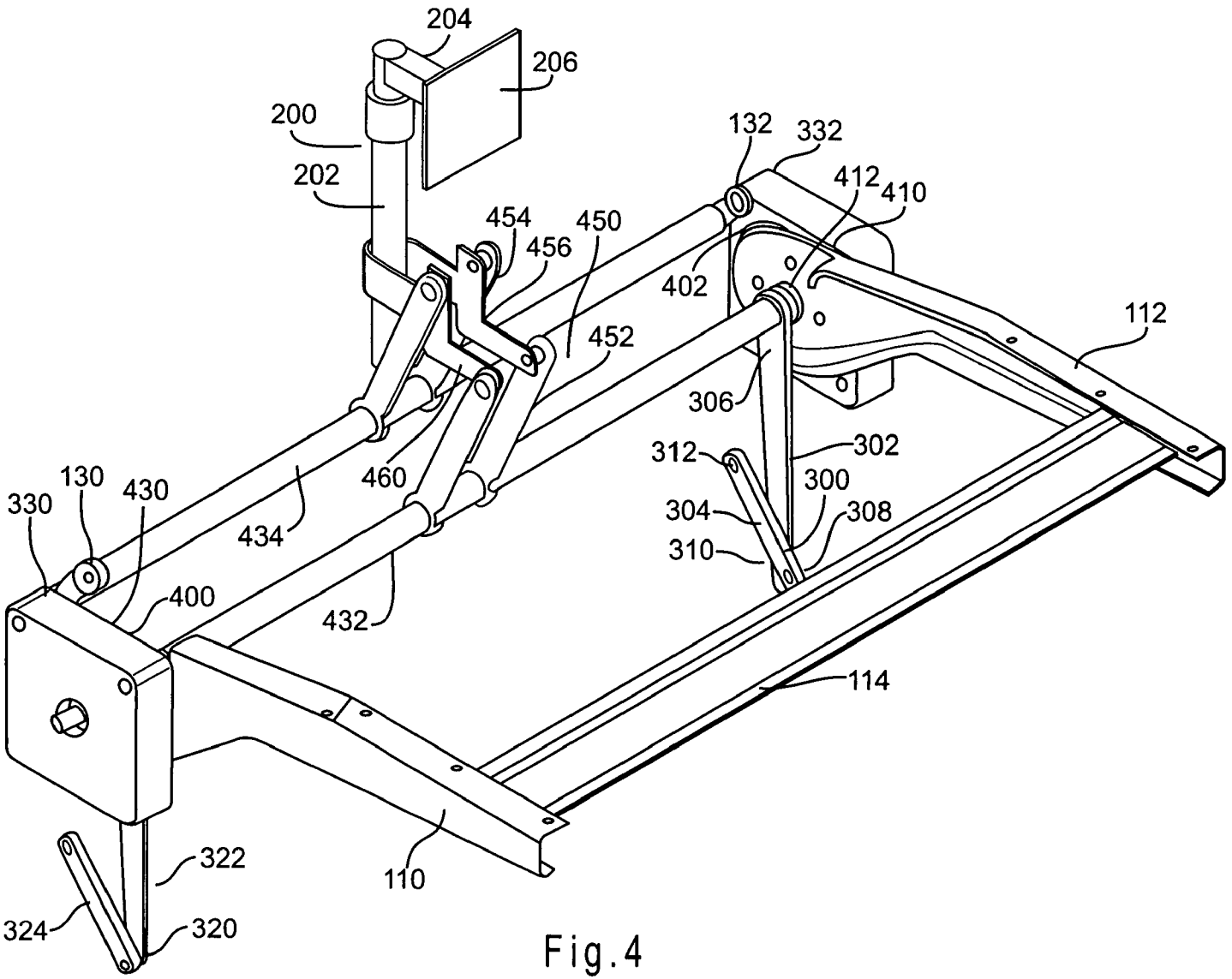
FIG. 4 is a perspective view of a first embodiment of a computer workstation with the worksurface removed.

FIG. 4 shows the structure of one embodiment of the computer workstation with the worksurface 100 removed. The worksurface is supported on each side by worksurface support members 110, 112. In one embodiment a lateral support member 114 runs between the two worksurface support members 110, 112 to provide additional support for the worksurface 100 and to brace the support members 110, 112. The worksurface support members 110, 112 are rotationally moveable around the axis of shaft 432 to allow the worksurface 100 to rotate from a horizontal position to an angled position toward a user.

In one embodiment, best seen in FIGS. 2 and 4, the computer workstation includes a pivot mechanism 300 coupling the worksurface 100 and/or the monitor support 200 to a base 350. The base 350 may be a stand-alone support, such as a self-supported vertical assembly, or it may be a furniture component, such as a wall of an existing workspace. The pivot mechanism 300 allows the worksurface to move in a fore-aft direction. It should be understood that the directions "fore" and "aft" refer to the position of the various components relative to the user, with "fore" or "forward" being proximate or toward the user and "aft" being distal or away from the user. The term "lateral" means side-to-side.

In one embodiment, the pivot mechanism 300 includes first 302 and second 304 pivot members, although other configurations are possible. Each pivot member includes a first and a second end. The first end 306 of the first pivot member 302 is coupled to the worksurface 100 or to shaft 432. The first end 310 of the second pivot member 304 is pivotally attached to the second end 308 of the first pivot member 302. The second end 312 of the second pivot member 304 is pivotally attached to the base 350. The pivot mechanism may be replaced by other mechanisms which provide for the transfer of translational movement into rotational movement. By "translational movement" is meant movement through space relative to a fixed point, including both linear and nonlinear movement. The workstation may include a second pivot mechanism 320. The second pivot mechanism 320 may be substantially identical to the first pivot mechanism 300 and may include a third pivot member 322 and a fourth pivot member 324.

As shown in FIGS. 2 and 4, to allow movement of the worksurface in a fore-aft direction and to vertically support the worksurface 100, the worksurface 100 is slidably coupled to the base 350. In one embodiment, the workstation includes a pair of side supports 330, 332. The side supports 330, 332 may be integrated with planetary gear housings 400, 402, as described below. A pair of rails 342 is attached to the base 350, and the side supports 330, 332 are slidably attached to the rails 342. The rails 342 support the weight of the worksurface 100. It will be apparent that other methods of slidably coupling the worksurface 100 to the base 350 are possible.

Figure 5:
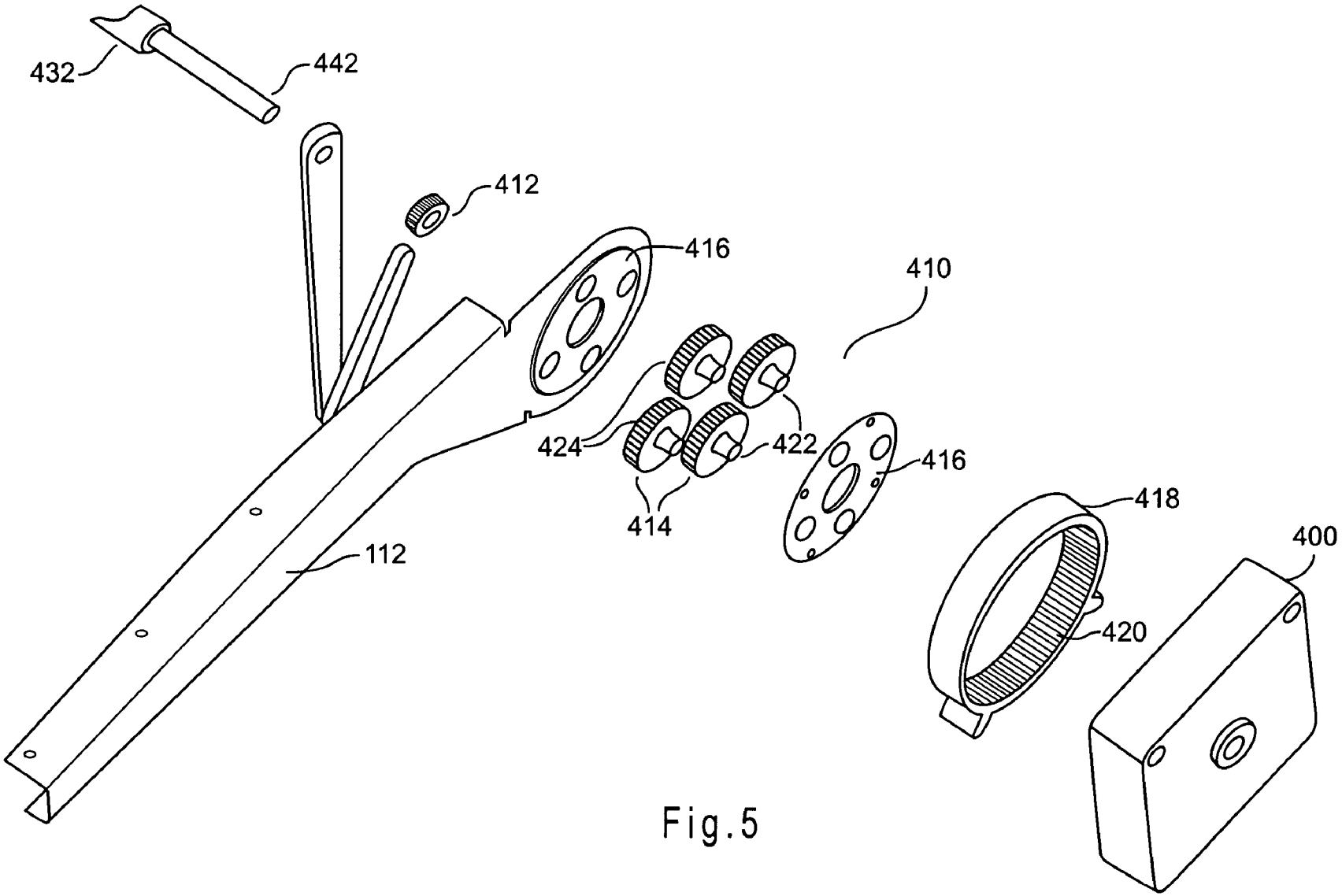
FIG. 5 is an exploded view of a first embodiment of a planetary gear assembly.

In one embodiment, as shown in FIGS. 4 and 5, the computer workstation includes a planetary gear assembly 410. The planetary gear assembly includes a sun gear 412, a planet gear 414 engaging the sun gear 412, a planet gear carrier 416, and a ring gear 418. The worksurface 100 is coupled to the planet gear carrier 416. In one embodiment, the worksurface support arms 110, 112 are non-rotatably attached to the planet gear carrier 416, as also shown in FIG. 5. The monitor support 200 is coupled to the sun gear 412. In one embodiment, a four bar linkage 450 couples the monitor support 200 to the sun gear 412. The first shaft 432 is non-rotatably secured to the sun gear 412 and the four bar linkage 450.

The components of the planetary gear assembly 410 are shown in FIG. 5. In one embodiment, the planetary gear assembly 410 is disposed in a planetary gear housing 400. The ring gear 418 is non-rotatably fixed within the housing 400. The ring gear 418 has internal teeth 420 facing radially inward. Disposed within the ring gear 418 are one or more planet gears 414. In one embodiment there are four planet gears 414, but other numbers of planet gears 414 are possible. The planet gears 414 rotate on shafts 422 mounted in the planet gear carrier 416. In an alternative embodiment, the planet gears 414 are fixedly attached to the shafts 422, and the shafts 422 are rotatably attached to the planet gear carriers 416.

In one embodiment, the planetary gear assembly 410 includes a pair of the planet gear carriers 416, one disposed on each side of the planet gears 414. The planet gears 414 have external teeth 424 facing radially outward that engage the internal teeth 420 of the stationary ring 418. The external teeth 424 of planet gears 414 also engage the radially outward directed teeth on the sun gear 412. The planet gear carrier 416 holds the shafts 422 of the planet gears 414. The planetary gear assembly 410 allows the sun gear 412 and the planet gear carrier 416 to rotate in the same direction but at different speeds.

As shown in FIG. 4, in one embodiment, first planetary gear assembly 410 is disposed on one side of the worksurface 100 and a second planetary gear assembly 430 is disposed on the other side of the worksurface 100. The first shaft 432 connects the sun gears 412 of each planetary gear assembly. The first shaft 432 is fixed at each end to each sun gear 412 and rotates with the sun gear.

The workstation may also include a second shaft 434 running between the planetary gear housings 400, 402 parallel to the first shaft 432. The second shaft 434 is rotatably attached to side supports 330, 332 that maintain the first and second shafts in parallel alignment. In one embodiment, the side supports 330, 332 define the planetary gear housings 400, 402. Although the first 432 and second shafts 434 are shown as cylindrical in FIG. 4, it is apparent that other shapes are possible.

In one embodiment, the monitor support 200 is pivotably coupled to the first 432 and second 434 shafts. In one embodiment the pivotal coupling is achieved by a four bar linkage 450. The four bar linkage 450 includes a first link 452 fixedly attached to the first shaft 432 and a second link 454 fixedly attached to the second shaft 434. The first and second links 450, 452 are pivotally attached to a third link 456. The computer workstation may have a second four bar linkage 460 which is substantially identical to the first four bar linkage 450. In one embodiment the four-bar linkage 450 is configured as a parallelogram with the first and second links 452, 454 being maintained parallel to each other. The four bar linkage 450 may be replaced by other mechanisms which allow for the transfer of the rotational movement of the shafts 432, 434 to a translational movement of the monitor support 200. The monitor support 200 may also include a mechanism to counterbalance the weight of the monitor. For example, a spring mechanism between one of the shafts 432, 434 and a fixed point can counterbalance the downward force created by the weight of the monitor, creating a smoother movement of the monitor support 200.

In one embodiment the sun gear 412 and planet gear carrier 416 are coupled, and horizontal movement of the worksurface 100 causes rotation of the sun gear 412, and rotation of the planet gear carrier 416 moves the worksurface 100 forward and downward. In one embodiment, at least a portion of worksurface 100 rotates downwardly toward the user. The gear ratio of the planetary gear assembly 410 is selected so that the sun gear 412 rotates through a greater angular distance than the planet gear carrier 416. In one embodiment the gear ratio between the sun gear 412 and the planet gear carrier 416 is between about 3:1 and about 10:1. In a further embodiment the gear ratio between the sun gear 412 and the planet gear carrier 416 is about 6:1. The gear ratios are selected so that a movement in the worksurface 100 creates a proportionally greater movement in the monitor support 200.

Thus, as shown in FIGS. 2, 3, and 4, as the worksurface 100 is moved forward from a first worksurface position to a second worksurface position, the pivot mechanism 300 engages the first shaft 432 and rotates it. The rotation of the first shaft 432 causes the four-bar linkage 450 to move, thus moving the monitor support 200 forward and downward. In one embodiment, the four-bar linkage 450 is configured as a parallelogram and prevents rotation of the monitor support 200 as it moves. It should be understood that in another embodiment, the four-bar linkage 450 is not configured as a parallelogram and the monitor support 200 also rotates as it translates. The side supports 330, 332, which in one embodiment define the planetary gear assembly housings 400, 402, thus also move forward on the rails 340, 342.

As shown in FIG. 6, in one embodiment, the worksurface 100 moves a horizontal distance $W_{HD}$ of between about 2 inches and about 18 inches, preferably between about 6 inches and about 12 inches, most preferably about 7.5 inches. In one embodiment, at least a portion of the worksurface 100 moves a vertical distance $W_{VD1}$ of up to about 6 inches, preferably between about 1 inch and about 4 inches, most preferably about 1.25 inches. In one embodiment, the forward portion 120 of the worksurface 100 moves a vertical distance $W_{VD1}$ of between about 1 inch and about 6 inches, and the rear portion 122 of the worksurface 100 moves a smaller vertical distance $W_{VD2}$ of between about 0 inch and about 2 inches. In one embodiment, the monitor support 200 moves a horizontal distance $M_{HD}$ between about 3 inches and about 20 inches, preferably between about 6 inches and about 14 inches, most preferably about 11 inches. In one embodiment, the monitor support 200 moves a vertical distance $M_{VD}$ of up to about 10 inches, preferably between about 1 inch and about 8 inches, most preferably about 5 inches. In one embodiment, at least portions of both the monitor support 200 and the worksurface 100 follow arcuate paths as they travel between first and second monitor support and worksurface positions, respectively.

FIG. 1 is a top perspective view of the worksurface 100. In one embodiment, the computer workstation has a one piece worksurface. In another embodiment, the worksurface 100 has two parts, a forward surface 120 and a rear surface 122. The rear worksurface 122 has a cutout 124 which provides an opening for the monitor support 200 and the four bar linkage 450. The front portion of the rear worksurface 122 is hingedly attached to the forward worksurface 120. In one embodiment, a piano hinge is disposed between the forward surface 120 and the rear surface 122 to provide the hinge connection. The worksurface 100 and forward worksurface 120 include, in one embodiment, an indented portion 126. In one embodiment, the contoured shape of forward worksurface 120 includes forearm support surfaces 128 and 138 adjacent to the indented portion 126. The rear portion of the rear worksurface 122 is pivotally supported by a pair of arms 130, 132. These arms 130, 132 are fixedly attached to the second shaft 434 and rotate with the second shaft 434, as shown in FIG. 4.

In one embodiment, the rear worksurface 122 maintains a generally horizontal position while the forward worksurface 120 moves downwardly and tilts toward the user as the worksurface 100 is moved toward the user from a first position to a second position. In one embodiment, the forward worksurface 120 rotates downwardly toward the user. Thus, the support surface of the worksurface forward worksurface 120 forms an angle with a horizontal plane. In one embodiment, the angle is between about 5 degrees and about 30 degrees, preferably about 7 degrees. The support surface is adapted to hold an item such as a keyboard. In another embodiment, the computer workstation has a single worksurface 100 which forms an angle with a horizontal plane.

In one embodiment, the center of the monitor support 200 is supported about 10 inches to about 18 inches about the worksurface 100. In one embodiment, the worksurface 100 has a width of about 48 inches, a depth of between about 32 inches and about 37 inches, and a thickness of about 0.75 inches. In another embodiment, the forward worksurface 120 has a width of about 48 inches, a depth of between about 13 inches and about 16 inches, and a thickness of about 0.75 inches, and the rear worksurface 120 has a width of about 48 inches, a depth of between about 13 and about 16 inches, and a thickness of about 0.75 inches.

In one embodiment, the monitor support 200 includes a vertical upright 202, a horizontally extending portion 204, and a monitor mounting surface 206. The vertical upright 202 is connected to the horizontally extending portion 204 and in one embodiment is adjustable in height. The horizontally extending portion 204 supports the monitor mounting surface 206. The monitor support 200 is capable of holding at least one monitor, although greater numbers of monitors are also envisioned. In one embodiment, the monitor mounting surface 206 is maintained in a substantially vertical plane even as it moves forwardly and downwardly. The monitor support 200 may be capable of further adjustment in the vertical direction. The horizontally extending portion 204 may be adjustable in the horizontal direction. The angle of the monitor support 200 may also be independently adjusted about one or more horizontal and vertical axes. The monitor mounting surface 206 may also be rotated to switch a monitor from a landscape to a portrait orientation.

In operation, the user, who is preferably seated, pulls or pushes the worksurface 100 in a fore-aft direction, toward or away from him, respectively. In one anticipated use, a user is positioned in front of the workstation in a tiltable chair. As the user tilts rearwardly in the chair, the user pulls the worksurface 100 toward him a first distance in a first direction from a first worksurface position to a second worksurface position, such that a keyboard positioned thereon is maintained in the same location relative to the hands of the user. As the worksurface 100 is moved forward, the pivot mechanism 300 engages the first shaft 432 and rotates it. The rotation of the first shaft 432 causes the four-bar linkage 450 to move, thus moving the monitor support 200 forward and downward.

The side supports 330, 332, which in one embodiment are the planetary gear assembly housings 400, 402, also move forward on the rails 340, 342. Rotation of the first shaft 432 rotates the sun gear 412, which in turn rotates the planet gear carrier 416. Rotation of the planet gear carrier 416 rotates at least a portion of the worksurface 100 downward. The gear ratio of the planetary gear assembly 410 is selected so that the sun gear 412 rotates through a greater angular distance than the planet gear carrier 416. Thus, the monitor support 200, and the monitor thereon, moves in the first direction toward the use at a greater rate than the movable worksurface 100.

In particular, the horizontal distance moved by the monitor support 200 is greater than the horizontal distance moved by the worksurface 100. In one embodiment, the vertical distance moved by the monitor support 200 is greater than the first vertical distance moved by the worksurface 100. It should be understood that other gear arrangements and configurations can be disposed between and couple the monitor support in the worksurface to effect relative movements thereof. In one embodiment, the monitor support 200 moves toward or away from the user at a ratio of between 1.1:1 and 2:1 relative to the movable worksurface 100, and preferably at a ratio of about 1.4:1. In essence, the monitor support 200 moves toward and away from a user at a greater rate and distance than the worksurface 100. This differential movement maintains the proper position of the monitor situated on a monitor support and the keyboard situated on the worksurface relative to the eyes and hands of the user respectively as the user tilts rearwardly in a chair.

It should be understood that the monitor support 200 can also be grasped and moved, which effects an automatic movement of the worksurface 100. As used herein, the reference to automatically moving the monitor support 200 in response to moving the worksurface 100 simply means that the worksurface 100 and monitor support are coupled to move relative to each other, regardless of which member is actually acted upon by the user, and includes without limitation the situation where the monitor support 200 is acted upon by the user, the situation where the worksurface 100 acted upon by the user, and the situation where one or both of the worksurface 100 and monitor support 200 are acted upon by one or more drive devices.

The capability of the monitor support 200 to move at a greater rate and to a greater distance than the worksurface can be useful for users sitting in a tilting chair. In particular, the hands of a user typically travel about half the distance of the head of a user when the user tilts rearwardly in a chair. Accordingly, the workstation is capable of maintaining a substantially constant and optimal distance between the user's eyes and the monitor supported on the monitor support, regardless of the tilt position of the user, as the worksurface is moved to accommodate the hands of the user.

Although the monitor support is designed to move in response to horizontal movement of the worksurface, it may be undesirable for the monitor support to move in response to a vertical force on worksurface, such as an object or the forearms of the user. Therefore, the computer workstation may also include a locking mechanism to prevent movement of the worksurface 100 when a vertical load is applied to it (such as the weight of the forearms of a user) to prevent inadvertent movement. This locking mechanism may include, for example and without limitation, a releasable lock on the gears of the planetary gear assembly.

An alternative embodiment of a computer workstation 12 is shown in FIGS. 7 through 11. The computer workstation 12 includes a monitor support 200 and a worksurface 100. The worksurface 100 and the monitor support 200 are coupled, so that as the worksurface 100 moves horizontally a first distance from a first worksurface position 50 (shown in FIG. 8) to a second worksurface position 52 (shown in FIG. 9), the monitor support 200 also moves a second distance from a first monitor position 40 to a second monitor position 42. In one embodiment, the monitor support 200 follows a linear path as it moves in both a horizontal direction and a vertical direction, and the worksurface 100 also follows a linear path as it moves in both a horizontal direction and a vertical direction. At least a portion of the worksurface 100 may rotate as the worksurface 100 is moved from the first worksurface position to the second worksurface position. In one embodiment, the second position 52 of the worksurface 100 is forward and downward of the first work surface position 50, and the second monitor position 42 is also forward and downward of the first monitor position 40.

Figure 10:
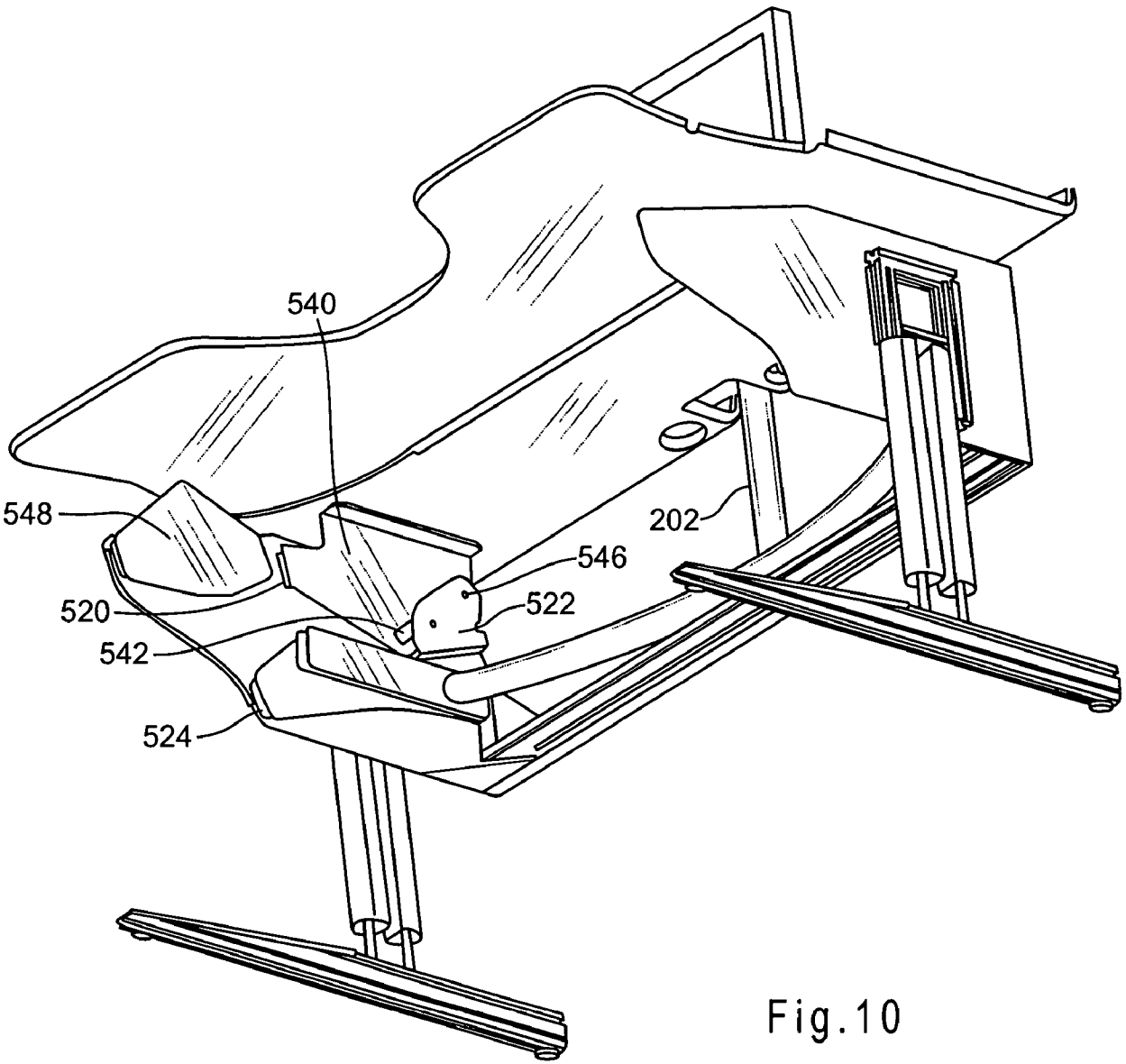
FIG. 10 is a bottom perspective view of a second embodiment of a computer workstation in a first configuration.
Figure 11:
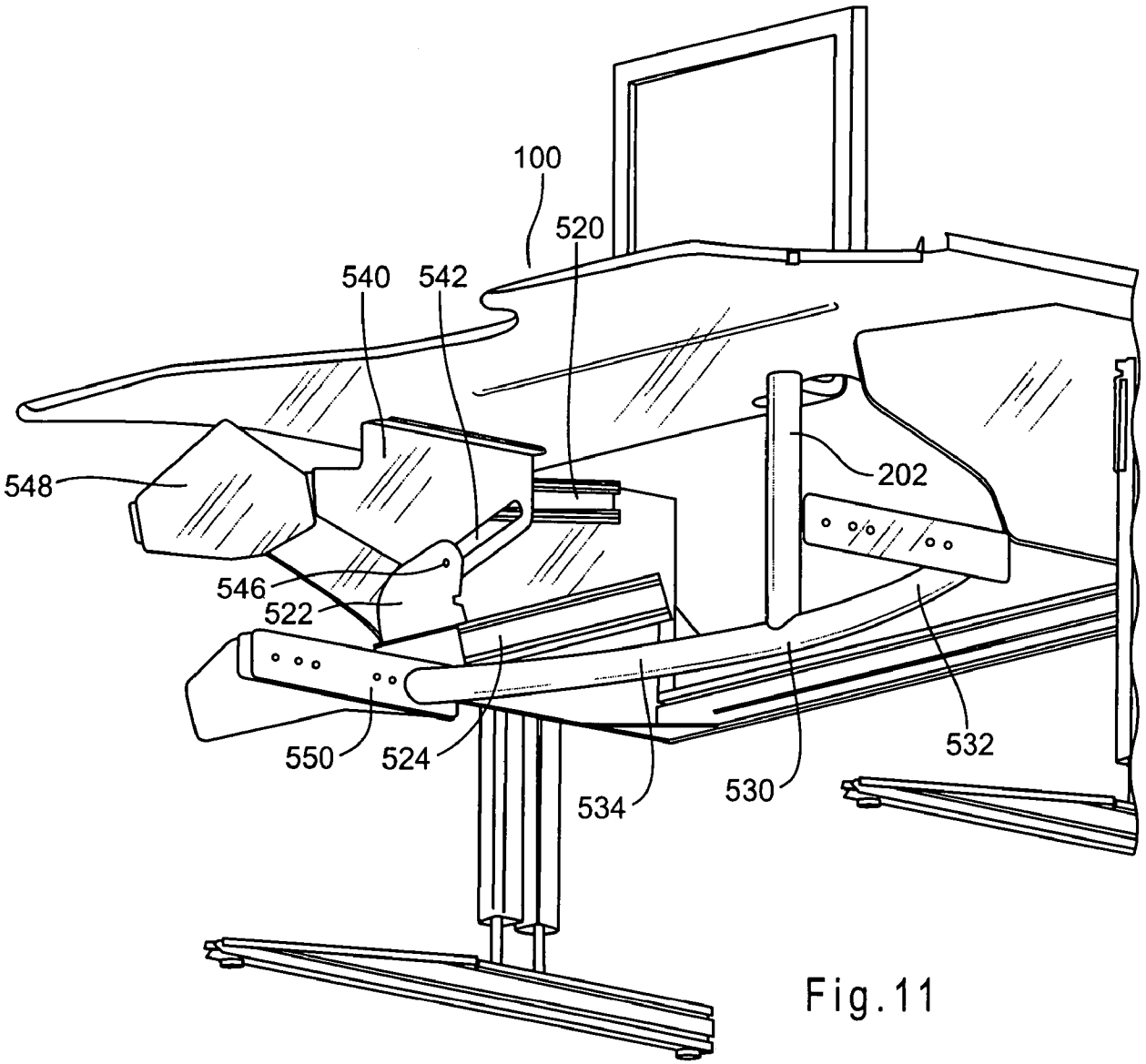
FIG. 11 is a partially cutaway view of a second embodiment of a computer workstation in a second configuration.

The workstation 12 includes a base 350 with legs 510, 512 and feet 514, 516. As best seen in FIGS. 10 and 11, a pair of upper tracks 520 and a pair of lower tracks 524 are secured to the base 350. The worksurface 100 is coupled to the upper tracks 520. The monitor support 200 is coupled to the lower tracks 524. An upper slide member 540 and a lower slide member 522 are slidably attached to each of the upper tacks 520 and lower tracks 524, respectively. Guides or carriages (not shown) are attached to the upper and lower slide members 540, 522 and are moveably connected to the tracks 520, 524 and are translatable thereon. It should be understood that the tracks could be any surface with the guide sliding or rolling thereon. In one embodiment, the upper tracks 520 and the lower tracks 524 each form an angle with a horizontal plane, with the rearward ends of each of the upper tracks 520 and the lower tracks 524 positioned higher than the respective forward ends. In one embodiment, the angle with respect to horizontal of the lower tracks 524 is larger than the angle of the upper tracks 520.

As shown in FIGS. 10 and 11, the monitor support 200 is secured to a vertical support member 202. Vertical support member 202 is coupled to a curved member 530. Curved member 530 includes two arms 532, 534 which are coupled to lower tracks 524. Upper slide member 540 is slidingly attached to track 520 and includes a downwardly angled channel 542. Lower slide member 522 is slidingly attached to lower tracks 524. A connector 546 pivotally and slidingly engages the lower slide member 522 with the upper slide member 540, with the connector 546 sliding in the channel 542. Connector 546 may be, for example, a wheel which rolls in, or slides along, channel 542 and is rotatingly attached to lower slide member 522. It should be understood that tracks 520, 524 and slide members 522, 540 could be replaced with other mechanisms for providing linear movement.

In operation, the user, who is preferably seated, pulls or pushes the worksurface 100 in a fore-aft direction, toward or away from him respectively. In one anticipated use, a user is positioned in front of the workstation in a tiltable chair. As the user tilts rearwardly in the chair, the user pulls the worksurface 100 toward him from a first worksurface position to a second worksurface position, such that a keyboard positioned thereon is maintained in the same location relative to the hands of the user.

As the worksurface 100 is moved forward, the upper slide member 540 moves forward and slightly downward along upper track 520. Upper slide member 540 engages connector 546, which moves lower slide member 522 forward and downward along track 524 as connector 546 moves along channel 542. Lower slide member 522 moves curved member 530 forward and downward, thus also moving the monitor support 200 forward and downward. Because upper track 520 and lower track 524 are at different angles, lower slide member 522 also moves relative to the upper slide member 540. The monitor support 200, and the monitor thereon, moves in the first direction toward the use at a greater rate than the movable worksurface 100.

Figure 7:
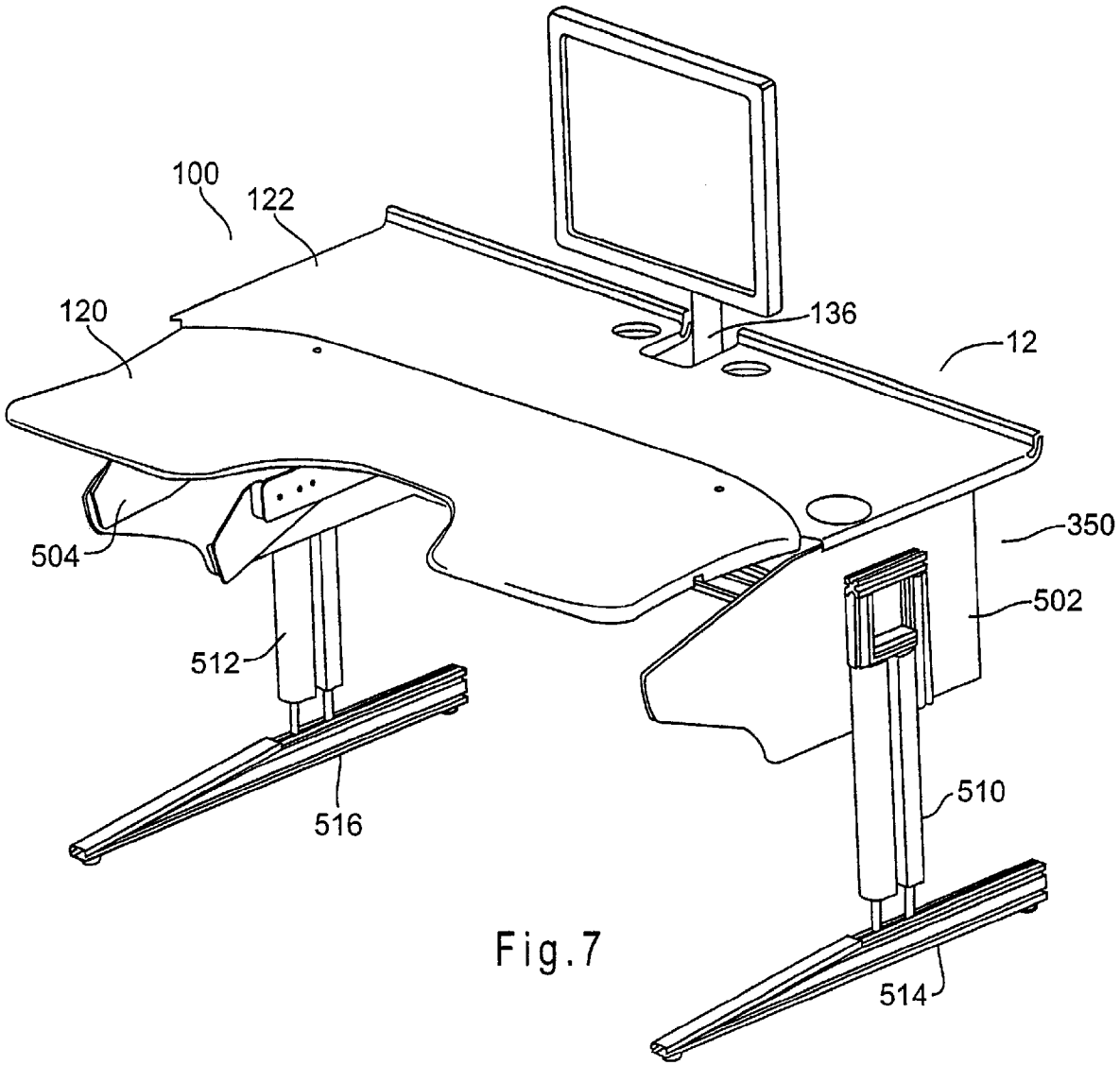
FIG. 7 is a perspective view of a second embodiment a workstation.

In one embodiment, as shown in FIG. 7, the worksurface 100 includes a forward surface 120 and a rear surface 122. The rear worksurface 122 has a cutout 136 which provides an opening for the monitor support 200. The front portion of the rear worksurface 122 is hingedly attached to the forward worksurface 120. The forward worksurface 120 is supported by support members 548. Support members 548 are coupled to upper slide members 540 and move along upper tracks 520.

In one embodiment, support members 548 rotate with respect to upper slide members 540 so that the forward worksurface 120 rotates downwardly toward the user as the worksurface moves from a first worksurface position 50 to a second worksurface position 50.

Figure 8:
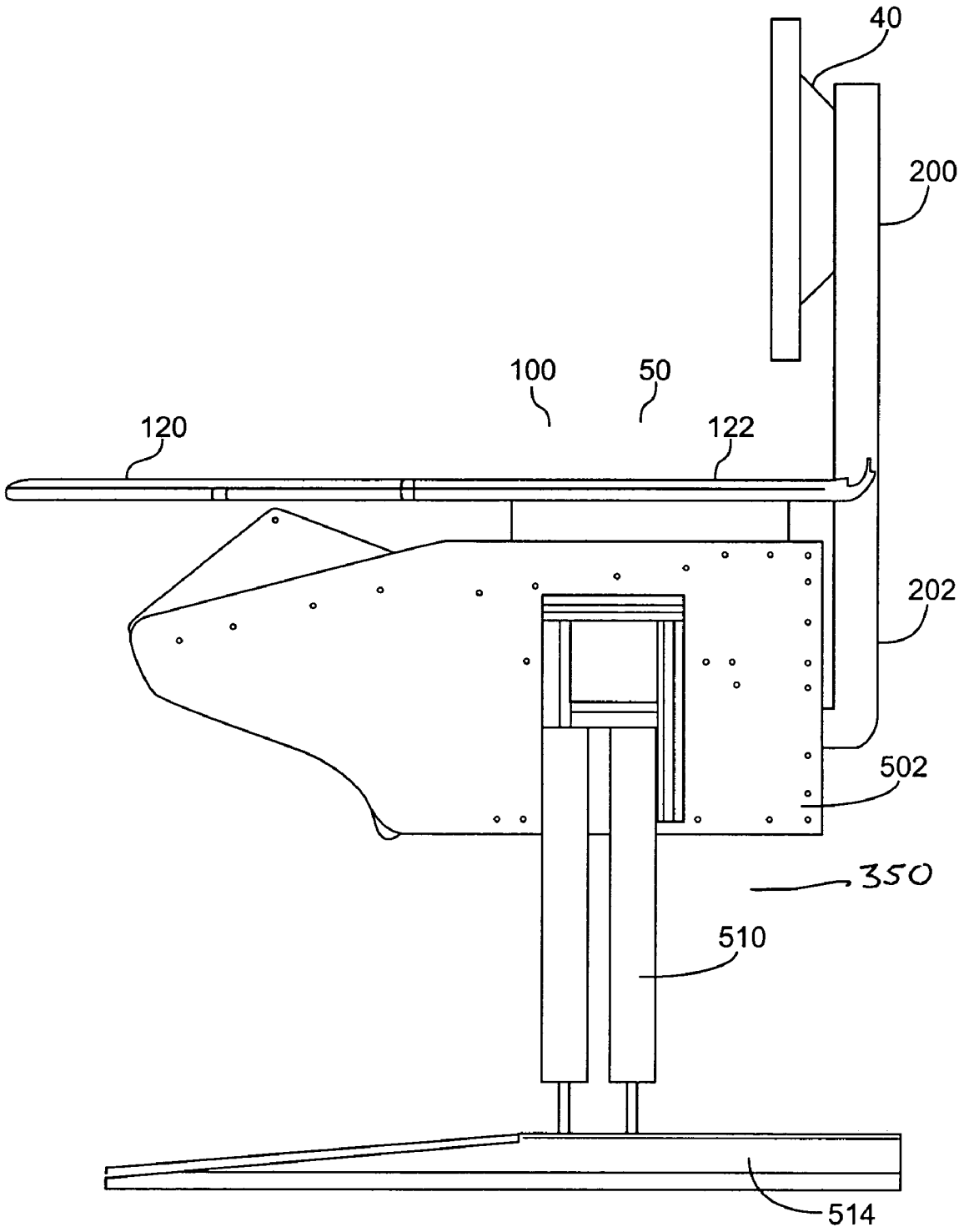
FIG. 8 is a side view of a second embodiment of a computer workstation in a first configuration.
Figure 9:
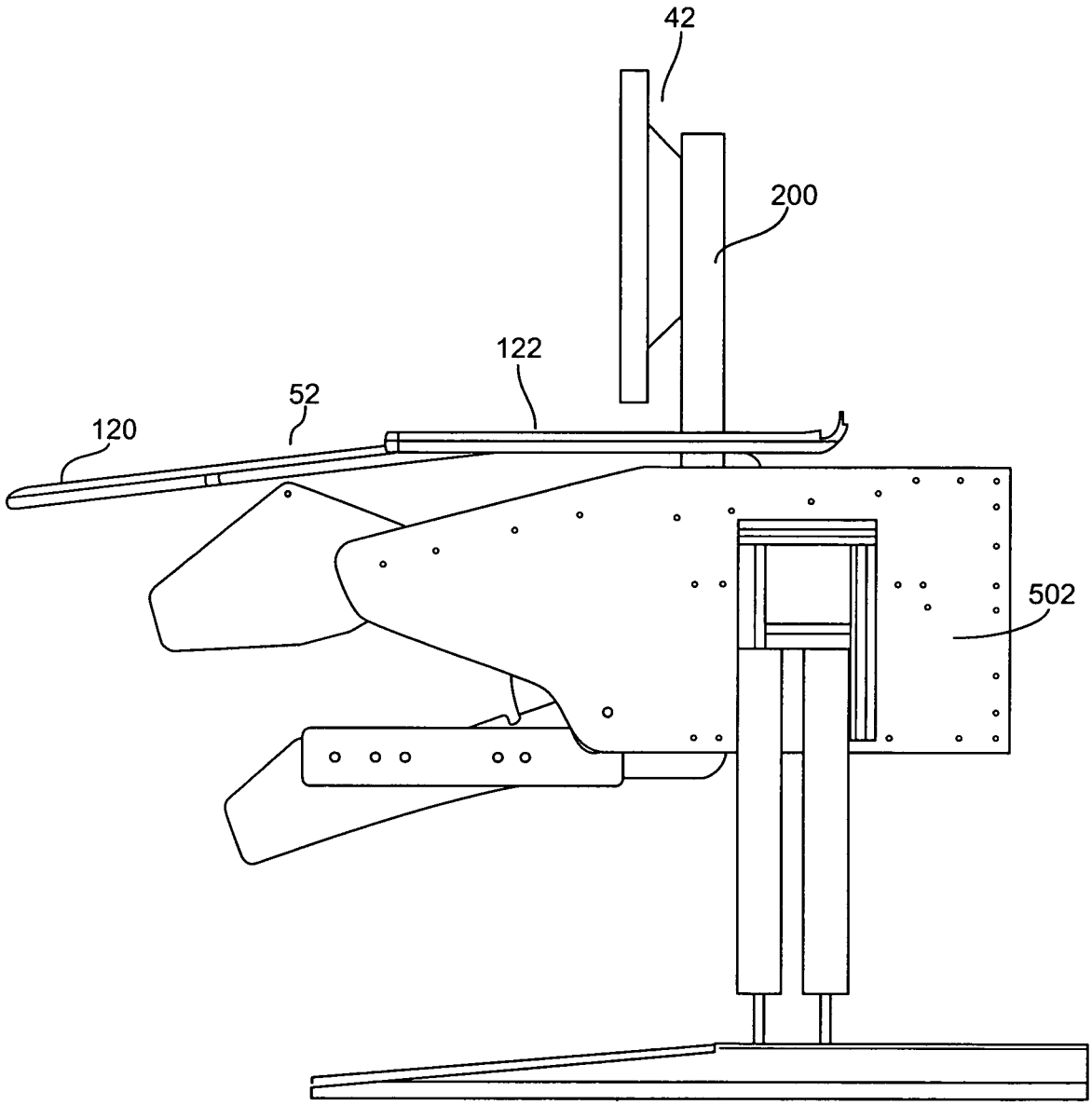
FIG. 9 is a side view of a second embodiment of a computer workstation in a second configuration.

In one embodiment, as seen in FIGS. 8 and 9, as the worksurface 100 is moved toward the user from a first position to a second position, the rear worksurface 122 maintains a generally horizontal position while the forward worksurface 120 moves downwardly and tilts toward the user. In one embodiment, the forward worksurface 120 rotates downwardly toward the user. Thus, the support surface of the worksurface forward worksurface 120 forms an angle with a horizontal plane. In one embodiment, the angle is between about 5 degrees and about 30 degrees, preferably about 7 degrees.

Although the present invention has been described with reference to preferred embodiments, those skilled in the art will recognize that changes may be made and formed in detail without departing from the spirit and scope of the invention. It is therefore intended that the foregoing detailed description be regarded as illustrative rather than limiting, and that it be understood that it is the following claims, including all equivalents, that are intended to define the scope of this invention.

What is claimed is:

1. A computer workstation comprising:

a worksurface moveable horizontally from a first worksurface position to a second worksurface position, wherein at least a portion of the worksurface rotates about a horizontal axis as the worksurface moves from the first worksurface position to the second worksurface position, and wherein an upper support surface defined by the portion of the worksurface rotates about the horizontal axis through an oblique angle as the worksurface moves from the first worksurface position to the second worksurface position;

a monitor support moveable horizontally and vertically, wherein the monitor support is moveably coupled to the worksurface, wherein the monitor support is moveable in response to a movement of the worksurface.

2. The computer workstation of claim 1 wherein the monitor support is moveable from a first monitor position to a second monitor position as the worksurface moves from the first worksurface position to the second worksurface position, wherein the second worksurface position is forward of the first worksurface position and the second monitor position is downward and forward of the first monitor position.

3. The computer workstation of claim 2 wherein the monitor support and the worksurface follow arcuate paths as they move from the first monitor position to the second monitor position and from the first worksurface position to the second worksurface position.

4. The computer workstation of claim 2 wherein the monitor support and the worksurface follow linear paths as they move from the first monitor position to the second monitor position and from the first worksurface position to the second worksurface position.

5. The computer workstation of claim 4 further comprising an upper track and a lower track, wherein the worksurface is coupled to the upper track and the monitor support is coupled to the lower track.

6. The computer workstation of claim 5 further comprising an upper slide member slidably engaging the upper track and a lower slide member slidably engaging the lower track.

7. The computer workstation of claim 6 wherein the upper slide member comprises a channel and the lower slide member comprises a connector slidably attached to the channel.

8. The computer workstation of claim 2 wherein as the worksurface moves a first horizontal distance between the first and second worksurface positions, the monitor is moveable a second horizontal distance between first and second monitor positions, wherein the second horizontal distance is greater than the first horizontal distance.

9. The computer workstation of claim 2 wherein the upper support surface of the worksurface forms an angle with a horizontal plane when the worksurface is in the second worksurface position.

10. The computer workstation of claim 9 wherein the angle is between about 5 degrees and about 30 degrees.

11. The computer workstation of claim 1 further comprising a base supporting the worksurface.

12. The computer workstation of claim 11 further comprising a pivot mechanism comprising first and second pivot members, each pivot member comprising a first end and a second end, the first end of the first pivot member coupled to the worksurface, the first end of the second pivot member pivotally attached to the second end of the first pivot member, and the second end of the second pivot member pivotally attached to the base.

13. The computer workstation of claim 12 wherein the worksurface is slidably coupled to the base.

14. The computer workstation of claim 13 further comprising a pair of rails attached to the base, wherein the worksurface is slidably coupled to the rails.

15. A computer workstation comprising:

a planetary gear assembly comprising a sun gear, a planet gear engaging the sun gear, and a planet gear carrier rotatably attached to the planet gear;

a worksurface coupled to the planet gear carrier; and a monitor support coupled to the sun gear;

wherein the worksurface or the monitor support is moveable in response to a movement of the other of the worksurface and the monitor support.

16. The computer workstation of claim 15 comprising a worksurface support member disposed beneath the worksurface and coupled to the planet gear carrier.

17. The computer workstation of claim 15 further comprising a shaft rotating with the sun gear and coupling the monitor support to the sun gear.

18. The computer workstation of claim 15 wherein the planetary gear assembly comprises a first planetary gear assembly and the sun gear, the planet gear and the planet gear carrier comprise respectively a first sun gear, a first planet gear, and a first planet gear carrier, and further comprising a second planetary gear assembly comprising a second sun gear, a second planet gear, and a second planet gear carrier.

19. The computer workstation of claim 18 further comprising a shaft comprising a first end and a second end, the first end attached to the first sun gear and the second end attached to the second sun gear, such that the shaft rotates with the first and second sun gears.

20. The computer workstation of claim 19 wherein the shaft comprises a first shaft, further comprising a second shaft maintained in parallel alignment with the first shaft, wherein the first and second shafts are coupled to the monitor support.

21. The computer workstation of claim 20 wherein the planetary gear assemblies are disposed in first and second planetary gear housings, and the second shaft is rotatably attached to the first and second planetary gear housings.

22. The computer workstation of claim 20 further comprising a four bar linkage coupling the first and second shafts to the monitor support.

23. The computer workstation of claim 22 wherein the four bar linkage is configured as a parallelogram.

24. The computer workstation of claim 15 wherein the sun gear and the planet gear carrier are coupled, and rotation of the planet gear carrier moves the worksurface downward, and rotation of the sun gear moves the worksurface and the monitor support forward.

25. The computer workstation of claim 24 wherein the gear ratio between the sun gear and the planet gear carrier is between about 3:1 and about 10:1.

26. The computer workstation of claim 24 wherein the gear ratio between the sun gear and the planet gear carrier is about 6:1.

27. The computer workstation of claim 15 further comprising first and second pivot members each comprising a first end and a second end, the first end of the first pivot member fixedly attached to the shaft, the first end of the second pivot member pivotally attached to the second end of the first pivot member, and the second end of the second pivot member pivotally attached to a base.

28. The computer workstation of claim 27 wherein the base comprises a furniture component.

29. A computer workstation comprising:

a worksurface moveable a first horizontal distance from a first worksurface position to a second worksurface position;

a monitor support moveably coupled to the worksurface;

a pivot mechanism coupling the monitor support to a base, wherein at least one of the worksurface and the monitor support is moveable in response to a movement of the other of the worksurface and the monitor support, wherein the monitor support is moveable a second horizontal distance between first and second monitor positions as the worksurface moves the first horizontal distance between the first and second worksurface positions, wherein the second horizontal distance is greater than the first horizontal distance, wherein the pivot mechanism comprises first and second pivot members each comprising a first end and a second end, the first end of the first pivot member coupled to the worksurface, the first end of the second pivot member pivotally attached to the second end of the first pivot member, and the second end of the second pivot member pivotally attached to the base.

30. The computer workstation of claim 29 further comprising a pair of side supports and a shaft rotatably attached to the side supports and disposed therebetween, wherein the first end of the first pivot member is fixedly attached to the shaft.

31. The computer workstation of claim 30 wherein the monitor support is pivotally coupled to the shaft.

32. The computer workstation of claim 31 further comprising a four bar linkage pivotally attaching the monitor support to the shaft.

33. The computer workstation of claim 32 wherein the shaft comprises a first shaft, further comprising a second shaft rotationally connected to each side support and fixedly attached to a link of the four bar linkage.

34. The computer workstation of claim 29 wherein the worksurface is slidably coupled to a furniture component.

35. The computer workstation of claim 30 further comprising a pair of rails attached to the furniture component, wherein the side supports are slidably attached to the rails.

36. A workstation comprising:

a rear worksurface having a front portion, wherein said rear worksurface is moveable within a first plane between a first rear worksurface position and a second rear worksurface position; and a front worksurface having a rear portion pivotally connected to said front portion of said rear worksurface about a pivot axis, wherein said front worksurface is automatically moveable with said rear worksurface from a first front worksurface position to a second front worksurface position, wherein said front worksurface pivots downwardly about said pivot axis as said front worksurface is moved from said first front worksurface position to said second front worksurface position, and wherein said front worksurface pivots through an oblique angle relative to said first plane as said front worksurface is moved from said first front worksurface position to said second front worksurface position.

37. The workstation of claim 36 wherein said front worksurface is positioned within said first plane when in said first front worksurface position.

38. The workstation of claim 36 wherein said front worksurface is hingedly connected to said rear worksurface about said pivot axis.

39. The workstation of claim 36 wherein said first plane is a substantially horizontal plane.

40. The workstation of claim 36 wherein said front worksurface has a substantially planar upper support surface.

41. The workstation of claim 36 wherein a front portion of said front worksurface comprises a forearm support.

42. The workstation of claim 41 wherein a front edge of said front worksurface comprises an indented portion defining a pair of forearm supports on opposite sides of said indented portion.

43. The workstation of claim 36 further comprising a base structure moveably supporting said rear and front worksurfaces.

44. The workstation of claim 36 wherein said front worksurface pivots between about 5 degrees and about 30 degrees relative to said first plane.

45. The workstation of claim 38 comprising a piano hinge hingedly connecting said front worksurface to said rear worksurface.

46. The workstation of claim 36 wherein said rear worksurface comprises a monitor support.

* * * * *

UNITED STATES PATENT AND TRADEMARK OFFICE

CERTIFICATE OF CORRECTION

PATENT NO. : 7,721,658 B2
APPLICATION NO. : 11/339988
DATED : May 25, 2010
INVENTOR(S) : Dral et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 981 days.

Signed and Sealed this
Eighteenth Day of January, 2011

David J. Kappos

David J. Kappos
*Director of the United States Patent and Trademark Office*